US008568186B1

(12) United States Patent
Sung et al.

(10) Patent No.: US 8,568,186 B1
(45) Date of Patent: Oct. 29, 2013

(54) SOUND EMITTING DOMINO SYSTEM AND THE SOUND EMITTING DOMINO

(71) Applicants: Pei-Chen Sung, Taipei (TW); Sheng-Feng Su, Taipei (TW)

(72) Inventors: Pei-Chen Sung, Taipei (TW); Sheng-Feng Su, Taipei (TW)

(73) Assignee: National Taiwan University of Science and Technology, Taipei (TW)

( * ) Notice: Subject to any disclaimer, the term of this patent is extended or adjusted under 35 U.S.C. 154(b) by 0 days.

(21) Appl. No.: 13/733,813

(22) Filed: Jan. 3, 2013

(30) Foreign Application Priority Data

Apr. 25, 2012 (TW) ..... 101207693 A

(51) Int. Cl.
*A63H 5/00* (2006.01)

(52) U.S. Cl.
USPC ..... 446/2; 446/397; 273/293

(58) Field of Classification Search
USPC ..... 446/2, 397; 273/293
See application file for complete search history.

(56) References Cited

U.S. PATENT DOCUMENTS

| | | | | |
|---|---|---|---|---|
| 3,315,404 | A * | 4/1967 | Rosen | 446/2 |
| 4,998,902 | A * | 3/1991 | Garner et al. | 446/2 |
| 5,349,129 | A * | 9/1994 | Wisniewski et al. | 84/600 |
| 5,405,281 | A * | 4/1995 | Sandor | 446/2 |
| 5,725,409 | A * | 3/1998 | Brunton | 446/2 |

* cited by examiner

*Primary Examiner* — Benjamin Layno
(74) *Attorney, Agent, or Firm* — Richard C. Vershave; Foster Pepper, PLLC

(57) ABSTRACT

In summary, the present invention provides a novelty electricity free domino that overcomes the overtone problem of the prior art and a domino system that is capable of controlling the interval of the sound generated by the sound emitting dominos may be extended so as to control the tempo thereof. Accordingly, the present creation not only solves the long last problem of long lasting overtone exists in the prior art but also has the advantages of simple and low manufacturing cost.

13 Claims, 4 Drawing Sheets

SOUND EMITTING DOMINO SYSTEM AND THE SOUND EMITTING DOMINO

PRIORITY CLAIM

This application claims the benefit of the filing date of Taiwan Patent Application No. 101207693, filed Apr. 25, 2012, entitled "SOUND EMITTING DOMINO SYSTEM AND THE SOUND EMITTING DOMINO," and the contents of which is hereby incorporated by reference in its entirety.

FIELD OF THE INVENTION

The present invention discloses a sound emitting domino system and a sound emitting domino.

BACKGROUND OF THE INVENTION

Domino generally refers to the collective gaming pieces making up a domino set (sometimes called a deck or pack) or to the subcategory of tile games played with domino pieces. However, besides playing games, another use of dominoes is standing them on end in long lines so that when the first tile is toppled, it topples the second, which topples the third resulting in all of the tiles falling. For large and elaborate arrangements, special blockages (also known as firebreaks) are employed at regular distances to prevent a premature toppling from undoing more than a section of the dominoes while still able to be removed without damage.

Please refer to the U.S. Pat. No. 5,405,281, it discloses a toppling tone-producing toy apparatus for producing a plurality of tones comprising a plurality of tiles, each tile having a front face, a back face, and a peripheral edge; a plurality of striker bars, each striker bar coupled to the back face of a tile; a note mechanism coupled to each tile for producing a tone when struck by a striker bar on another tile; a support mechanism for holding the tiles thereon; and a plurality of hinges, each hinge coupling the peripheral edge of each tile to the support mechanism for allowing pivotal movement of the tile, the coupling of the tiles with the support mechanism creating a generally aligned configuration where the front faces of the tiles are directionally aligned and each tile is offset from adjacent tiles by a distance less than its height such that when a tile is toppled towards an adjacent tile, its striker bar contacts the note mechanism of the adjacent tile, whereby toppling the adjacent tile, producing a tone, and creating a toppling effect that ripples through the remainder of the configuration, thus producing a plurality of tones from the note mechanisms of subsequent toppling tiles. However, each of the note bars of the said domino is not capable of emitting sound by itself without the strike of the striker bar of another domino, therefore, the relative position of the dominos have to be carefully arranged and be aligned or the tone or sound emitted thereof shall not work properly, meanwhile, the aligning of the dominos may takes a long time.

Furthermore, please refer to the ROC patent number M376331, it utilizes a ram to strike onto to a string so as to generate a tone thereby, however, after striking, the string shall keep vibrating until the energy thereof is exhausted and noise (overtone) shall keep generating during the said process.

Therefore, a need exists, for a sound emitting domino that is capable of generating sound by its own and overcoming the overtone problem of the prior art. Furthermore, another need exists that a domino system that is capable of controlling the interval of the sound generated by the sound emitting dominos without accurate alignment may be extended so as to control the tempo thereof.

SUMMARY OF THE INVENTION

In one aspect of the invention, a sound emitting domino (hereinafter called as the domino) is provided. The domino comprises a casing, a sound emitter and a ram. The casing has an accommodating spacing formed therein, the sound emitter is disposed in the accommodating spacing of the casing and fixed therewith. The ram is movably disposed in the accommodating dating spacing of the casing. Wherein, while the domino topples, the arm thereof strikes the sheet shaped sound emitter so as to generate a sound wave having a predetermined wavelength by the vibration thereof.

While in actual practice, the casing may optionally have a through hole formed on the surface thereof so as to connect the accommodating spacing with the external environment. Furthermore, the sound emitter may has a first surface and a corresponding second surface, the first surface faces toward the ram and the second surface faces toward the through hole of the casing. Furthermore, the domino may further comprises a restoring unit, having a fixing portion and a loading portion, the fixing portion fixed with the casing and the loading portion directly connected with the ram, wherein, the restoring unit may be, or may not be, a spring and the loading portion thereof is located at the internal surface thereof. Apart from the said design, the restoring unit may, but not limited to, be a flexible arm, which the loading portion thereof is located at one of the top end of the flexible arm.

Nevertheless, the domino may further comprises a stabilizing unit, disposed in the accommodating spacing so as to stabilize the ram by constantly applying an external force or additional force thereto, wherein the stabilizing unit may be a plant shaped magnet and the magnet is optionally bendable.

Furthermore, the domino may further optionally comprises a base and a buffering module, the sound emitter fixed to the casing via the base and the buffering module is disposed on the surface of the casing for buffering the shock caused by the topple, wherein the buffering module has a hollow portion formed therein for accommodating casing, the shape of the hollow portion is corresponding to the shape of the casing.

In another aspect, the present invention discloses a sound emitting domino system comprising a first sound emitting domino as the sound emitting domino described in the claim 1, capable of emitting a first sound while be triggered; a second sound emitting domino as the sound emitting domino described in the claim 1, capable of emitting a second sound while be triggered and at least one solid domino, disposed between the first sound emitting domino and the second sound emitting domino so as to adjust the interval between the first sound and the second sound or the tempo thereof.

In summary, the present invention provides a novelty domino that overcomes the overtone problem of the prior art and a domino system that is capable of controlling the interval of the sound generated by the sound emitting dominos may be extended so as to control the tempo thereof.

BRIEF DESCRIPTION OF THE DRAWINGS

The teachings of the present invention can be readily understood by considering the following detailed description in conjunction with the accompanying drawings, in which.

DETAILED DESCRIPTION

Figure 1:
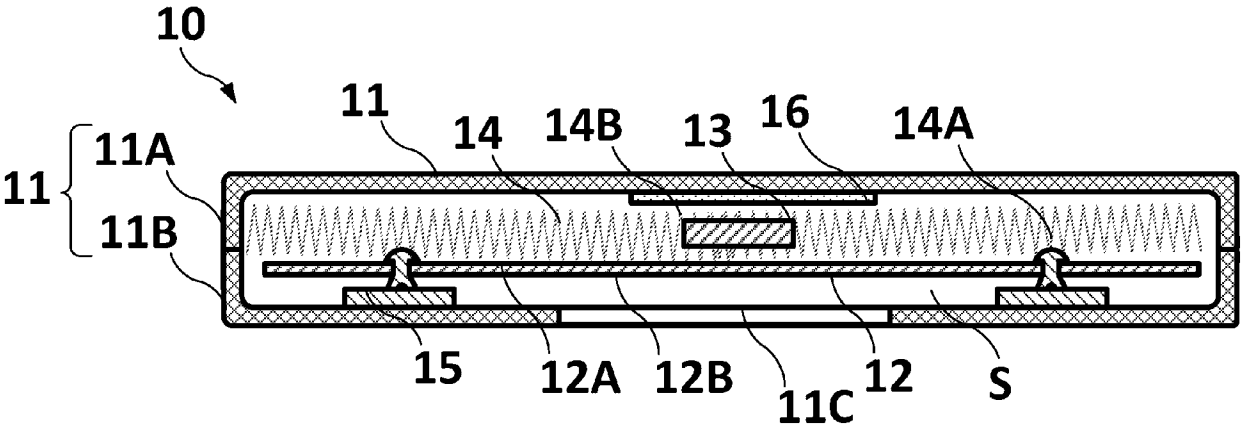
FIG. 1 depicts a cross section area of a preferred embodiment of the domino of the present invention.

The present invention generally provides a sound emitting domino system, a sound emitting domino and a buffering module thereof. Please refer to FIG. 1, the FIG. 1 depicts a cross section area of a preferred embodiment of the domino of the present invention. By the FIG. 1, it is clearly shown that the present invention of domino 10 is mainly composed of a casing 11, a sound emitter 12 and a ram 13. More specifically, while the sound emitting domino 10 topples, the arm 13 strikes the sheet shaped sound emitter 12 so as to generate a sound wave having a predetermined wavelength by the vibration thereof with no electricity needed at all. By the design of sheet shaped sound emitter, the present invention overcomes the problem of overtone of the prior art.

More specifically, please refer to FIG. 1, in the preferred embodiment, the casing 11 may, but not limited to, composed of at least one upper casing 11A and one lower casing 11B fixed therewith. Furthermore, the casing 11 is not limited to the said design but also may be one piece formed. Moreover, the casing 11 has an accommodating spacing S formed therein between the upper casing 11A and the lower casing 11B. Meanwhile, in the preferred embodiment of FIG. 1, one through hole 11C is formed on the surface of the lower casing 11B so as to connect the accommodating spacing S with the outer space, which allows the sound wave generated by the sound emitter 12 to output via the through hole 11C. It should be noticed that the casing 11 may has more than one through hole 11C formed thereon, furthermore, apart from the lower casing 11B, the through hole 11C may also be formed on the upper casing 11A or any other possible position of the casing 11.

Furthermore, in the present embodiment, the casing 11 may, but not limited to, be formed of polymer material by molding process. In additionally, the casing 11 can also be formed of metal, wood or any other non-crystal material by machining process not previously listed. Moreover, in the preferred embodiment as depicts in the FIG. 1, the sound emitter 12 refers to a piece shaped thin metal plate.

Furthermore, in the present embodiment, the sound emitter 12 may, but not limited to, be an electricity free unit. Please refer to the FIG. 1 of the present invention, in the present embodiment, the sound emitter 12 refers to a piece shaped thin metal plate, such as a reed, which is capable of generating a sound wave having predetermined frequency via the vibration thereof. Meanwhile, by changing the shape, length, thickness, material or the fixation position of sound emitter 12, the duration, music scale or volume generated by sound emitter 12 may also be adjusted correspondingly.

Furthermore, the sound emitter 12 has a first surface 12A and a corresponding second surface 12B. In the present embodiment, the first surface 12A faces the ram 13 and the second surface 12B faces the through hole 11C of the casing 11. By the FIG. 1, the sound emitter 12 is disposed in the accommodating spacing S of the casing 11 and be relatively fixed with the casing 11. More specifically, in the present embodiment, the sound emitter 12 is fixed to the casing 11 via two base 15 which each of the base 15 is preferred, but not limited, to be fixed to the lower casing 11B and penetrates both surface of the lower casing 11B so as to be fixed thereto.

Moreover, each of the base 15 is disposed in the accommodating space S between the sound emitter 12 and the casing 11. Furthermore, the base 15 may, but not limited to, be formed of a soft polymer material and the base may capable of having a small degree of elastic deformation so as to absorb and decrease the duration and degree of the vibration of the sound emitter 12 and overcome the problem of overtone. In the preferred embodiment, each of the bases 15 may directly contacts with both sound emitter 12 and casing 11 so as to further absorb the vibration of the sound emitter 12 and decreases the overtone causes thereby.

Meanwhile, the ram 13 is disposed at the accommodating spacing S between the said first surface 12A and the casing 11 for striking the sound emitter 12 so as to generate a sound wave having a predetermined wavelength of frequency thereby, in the preferred embodiment, the ram 13 is, but not limited to, a rigid and solid metal block.

In another hand, the domino 10 of the present invention may further optionally comprise a restoring unit 14 and a stabilizing unit 16. The restoring unit 14 is disposed in the accommodating spacing and be connected with the casing and be utilized to maintain the relative position of the ram 13 and the casing 11. The restoring unit has a fixing portion 14A and a loading portion 14B, and the fixing portion 14A is fixed with the casing and the loading portion 14B is directly connected with the ram 13 so as to maintain the position thereof. In the present embodiment, the restoring unit 14 may be, but not limited to, a spring like structure having a hollow space formed therein for accommodating the ram 13 therein. However, it should be noticed that the ram 13 is not limited to be disposed into the hollow space of the spring like structure, but may also be disposed onto the outer surface of the spring or any other possible position that is capable of providing the same function thereof as previously described.

More specifically, the fixing portion 14A refers to the portion that the restoring unit 14 connected with casing 11, and the loading portion 14B refers to the portion that utilized for affording the ram 13 and connected thereto. Meanwhile, the restoring unit 14 may further be classified into a far condition, a stable condition and a close condition in accordance with the relative position to the sound emitter 12.

Figure 2:
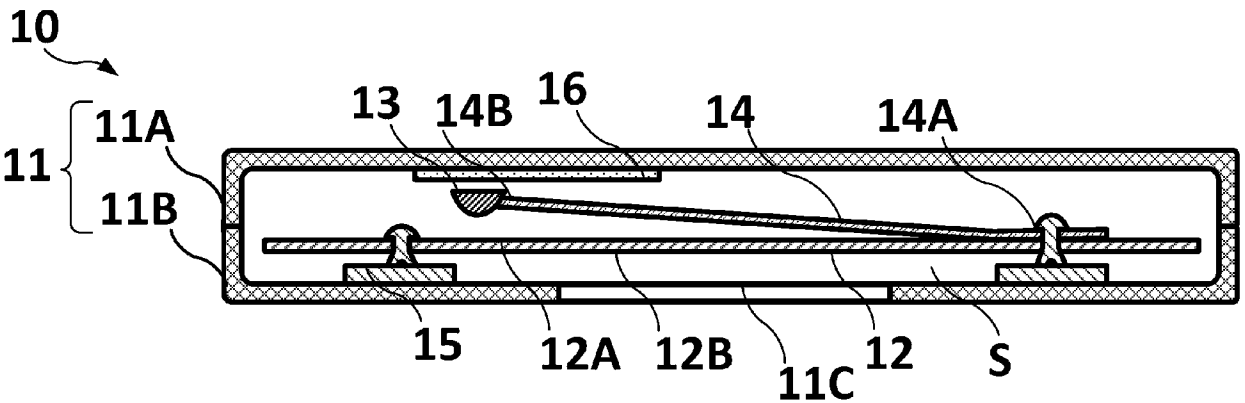
FIG. 2 depicts a cross section area of another embodiment of the domino of the present invention.

The stabilized condition refers to a condition that the position of the restoring unit 14 and the ram 13 disposed therein are both in a static status. The far condition refers to a condition that the minimum displacement between the ram 13 and the sound emitter 12 is greater than the stabilized condition. The close condition refers to a condition that the minimum displacement between the ram 13 and the sound emitter 12 is smaller than the stabilized condition. For example, while in the far condition, the loading portion 14B of the restoring unit 14 deforms toward the direction opposite to the sound emitter 12. However, while in the close condition, the loading portion 14A of the restoring 14 deforms toward the direction toward the sound emitter 12. Furthermore, restoring unit 14 of the present invention is not limited to a spring, it can also be a flexible arm having one end fixed with the casing 11 and the end fixed with the arm 13 as FIG. 2 shown.

Furthermore, please refer to the FIG. 1, the present invention may optionally comprises a stabilizing unit 16 so as to stabilize the ram or to fix the ram onto the casing by constantly applying an external force or additional force thereto, which the external force applied to the ram 13 may be proportional to the displacement therebetween. In the embodiment of the FIG. 1, the stabilizing unit 16 may be a soft plant shaped magnetic material, such as a soft magnet or a piece shaped bendable magnet. In actual practice, the stabilizing unit 16 is disposed on the surface of the upper casing 11A that faces the first surface 12A of the sound emitter 12.

Figure 3A:
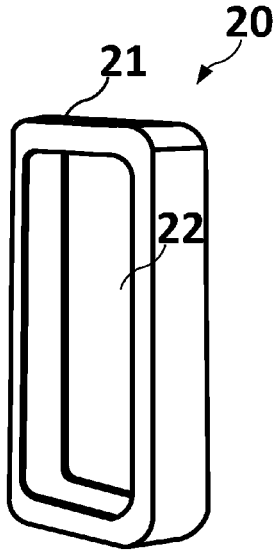
FIG. 3A depicts a schematic figure of the preferred embodiment of the buffering module of the present invention.
Figure 3B:
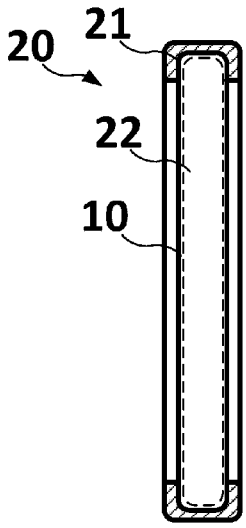
FIG. 3B depicts a cross section figure of the preferred embodiment of the buffering module of the present invention.

Furthermore, the domino 10 of the present invention may further comprise a buffering module 20 as the FIGS. 3A and 3B shown. The FIG. 3A and FIG. 3B respectively depicts a schematic figure and a cross section figure of the preferred embodiment of the buffering module of the present invention. The buffering module 20 is disposed on the outer surface of the casing 11 so as to absorb the shock caused by the topple thereof and capable of minimize the noise generated by the strike. The buffering module 20 may comprises at least one buffering unit 21. The buffering unit 21 may be formed of an elastic material that cover the domino 10 completely or be fixed on the certain surface thereof so as to absorb the shock thereof. In the present embodiment, the said buffering module 20 has a hollow portion 22 formed therein which the shape of the said hollow portion 22 may be corresponding to the shape of the casing 11 of the domino 10. Furthermore, the buffering unit 21 may be formed of a soft material, such as silicon, and be manufactured by casting process. It needed to be notice that the thickness of the whole buffering module 20 may or may not be even in accordance with the requirement of the designer. More specifically, the position, weight, thickness or other parameters that not be mentioned of the buffering unit 21 may be adjusted by the requirement of the user in order to modify the centroid or mass centric so as to adjust the difficulty of toggling the domino 10.

Figure 4A:
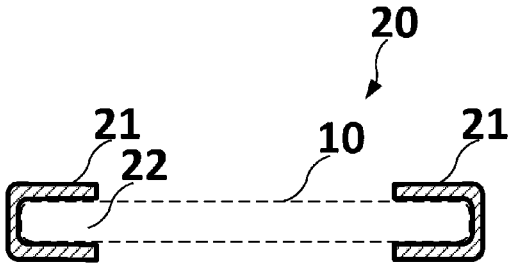
FIG. 4A depicts a cross section figure of another embodiment of the buffering module of the present invention.
Figure 4B:
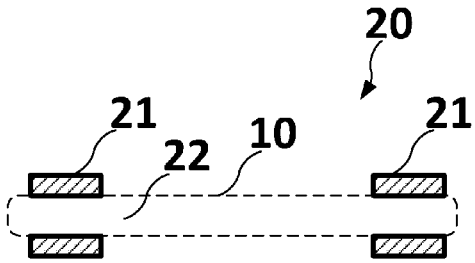
FIG. 4B depicts a cross section figure of another embodiment of the buffering module of the present invention.

Furthermore, the said buffering module 20 is not limited to be applied to the sound emitting domino 10 of the preset invention and can be utilized independently at the other kind of domino. It should be noticed that the common design rule of the domino of the prior art preferred a clear and melodious strike sound by striking the domino 10, therefore, the one skilled in art shall has no motivate to utilize the buffering module 20 thereto. Furthermore, more possible embodiments of the buffering module 20 are disclosed in FIGS. 4A and 4B.

The way of use of the domino of the present invention shall be described herein so as to clarity the details. Please refer to the FIG. 5A to FIG. 5B, the FIG. 5A to FIG. 5D respectively depicts a schematic figure of relative position of the ram 13 and restoring unit 14 in different situations. Meanwhile, a fixed block B is defined in the figures for reference. Please refer to the FIG. 5A, the user disposes the domino 10 onto the surface vertically, wherein the ram 13 is disposed in the restoring unit 14 and the resorting unit 14 is in the stabilized condition. Then, please refer to FIG. 5B, an external force is applied to the domino 10 and the domino 10 topples toward the surface that having the through hole 11C formed thereon, meanwhile, the ram 13 is attracted and fixed onto the casing 11 by the stabilizing unit 16, the resorting unit 14 in the far condition. Please refer to the FIG. 5C, while the domino 10 strikes the ground, the domino 10 is stopped, however, the inertia of the ram 13 overcome the external force applied thereto by the stabilizing unit 16 and strikes the sound emitter 12 so as to generate a sound wave having a predetermined wavelength, then the sound wave shall outputs to the external space via the penetrate hole 11C of the casing 11, the resorting unit 14 is now in the close condition.

Figures 5A, 5B, 5C, 5D:
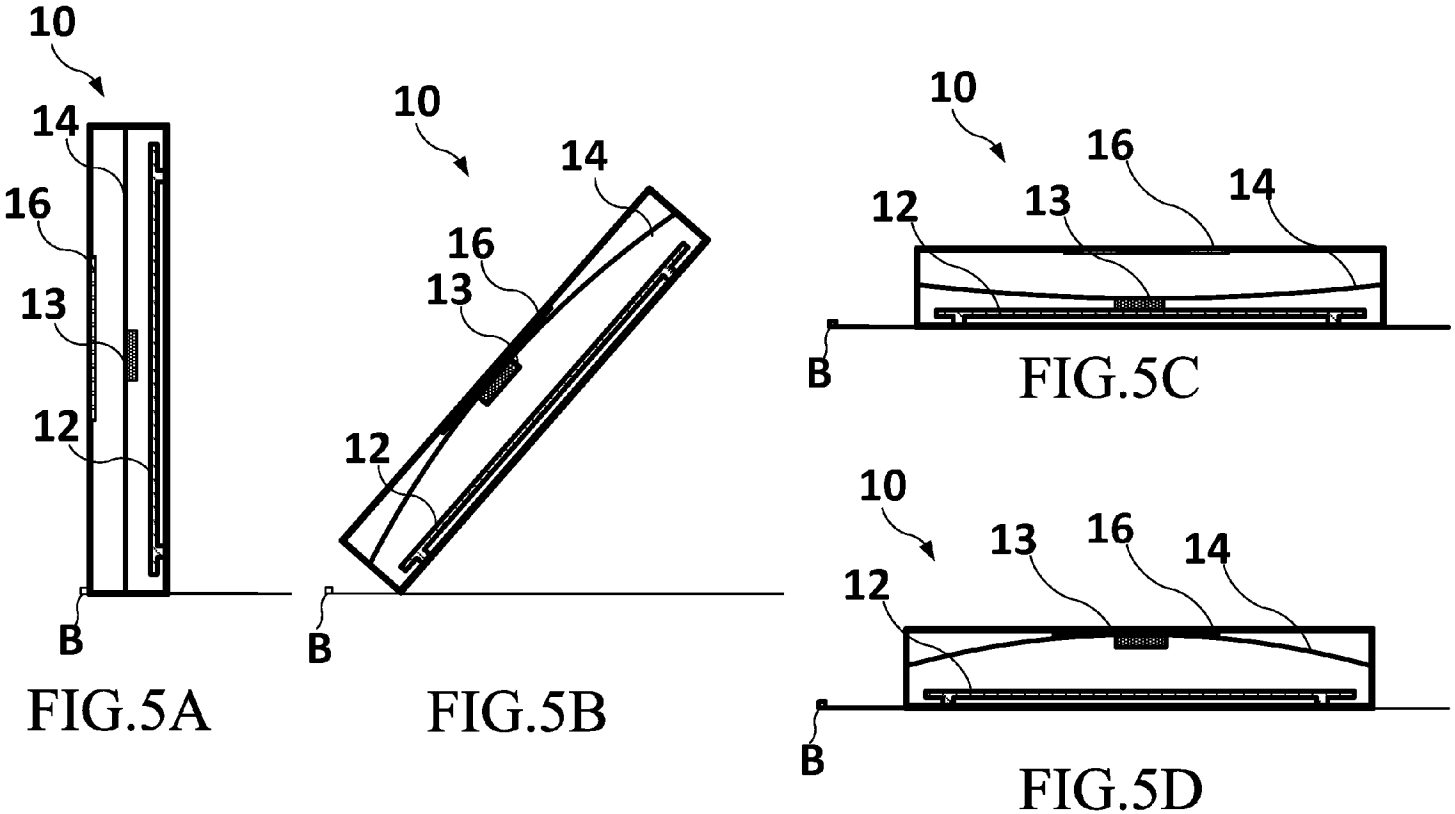
FIG. 5A to FIG. 5D respectively depicts a schematic figure of relative position of the ram and restoring unit in different situations.

Then, please refer to the FIG. 5D, after the ram 13 strikes the sound emitter 12, the ram 13 shall be pushed by the restoring unit 14 and moves toward the stabilizing unit 16, then the ram 13 may be once again be attracted by the stabilizing unit 16 so as to be attached thereto. Therefore, by the stabilizing unit 16, the ram 13 shall not strike the sound emitter 12 again so as to avoid the generation of the overtone.

Figure 6:
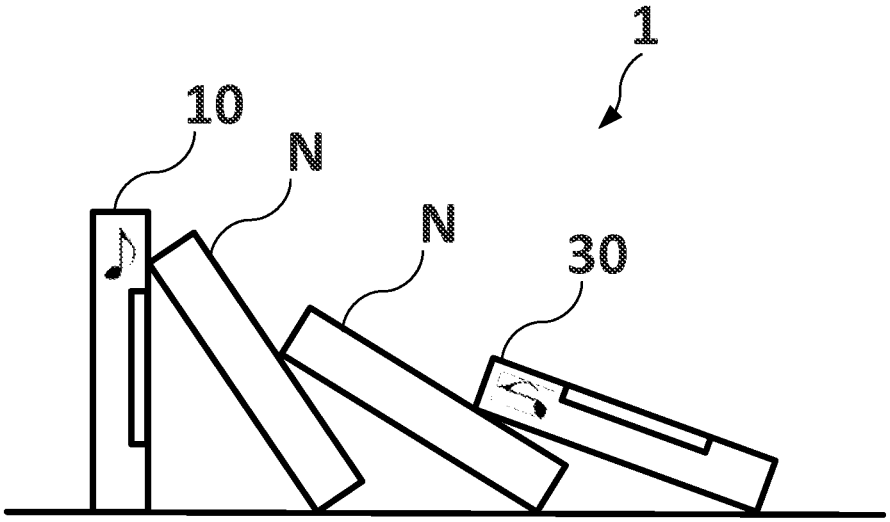
FIG. 6 depicts a schematic figure of an embodiment of the sound emitting domino system of the present invention.

Furthermore, while in actual practice, the domino of the present invention may be mixed with other normal domino which shall not have the sound generating mechanism of the present invention so as to form a sound emitting domino system 1 that provides the flexibility required during the composition of the music process. More specifically, by disposing at least one normal or solid domino between two sound emitting dominos, the interval of the sound generated by the dominos may be extended so as to control the tempo thereof. For example, please refer to the FIG. 6, the FIG. 6 depicts a schematic figure of an embodiment of the sound emitting domino system of the present invention. It is clearly shown that the sound emitting domino system 1 is composed of at least one first sound emitting domino 10, at least one normal domino N and at least one second sound emitting domino 30. The first sound emitting domino 10 and the second sound emitting domino 30 may or may not be the sound emitting domino 10 of the present invention set forth and capable of emitting a first sound and a second sound respectively while it is triggered. And the said normal domino N may refer to a normal or solid domino that has no sound emitting or generating mechanism therein. It should be noticed that, apart from the domino having a mechanical sound emitting design set forth, the sound emitting domino of the domino may also be electrically driven.

In summary, the present invention provides a novelty domino that overcomes the overtone problem of the prior art and a domino system that is capable of controlling the interval of the sounds generated by the sound emitting dominos may be extended so as to control the tempo thereof.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

The invention claimed is:

1. A sound emitting domino, comprising:

a casing, having an accommodating spacing formed therein;

a sound emitter, disposed in the accommodating spacing and fixed therewith;

a ram, movably disposed in the accommodating spacing of the casing;

wherein, while the domino topples, the ram strikes the sound emitter so as to generate a sound wave having a predetermined wavelength by the vibration of the sound emitter.

2. The sound emitting domino of the claim 1, wherein the casing has a through hole formed on the surface thereof so as to connect the accommodating spacing with the external environment.

3. The sound emitting domino of the claim 2, wherein the sound emitter has a first surface and a corresponding second surface, the first surface faces toward the ram and the second surface faces toward the through hole of the casing.

4. The sound emitting domino of the claim 1, further comprising a restoring unit, the restoring unit having a fixing portion and a loading portion, the fixing portion being fixed with the casing and the loading portion being directly connected with the ram.

5. The sound emitting domino of the claim 4, wherein the restoring unit is a spring and the loading portion is located at the internal surface thereof.

6. The sound emitting domino of the claim 4, wherein the restoring unit is a flexible arm, the loading portion is located at one of the top end of the flexible arm.

7. The sound emitting domino of the claim 1, further comprising a stabilizing unit, and the stabilizing unit being disposed in the accommodating spacing so as to stabilize the ram by constantly applying an additional force thereto.

8. The sound emitting domino of the claim 7, wherein the stabilizing unit is a plant shaped magnet.

9. The sound emitting domino of the claim 8, wherein the stabilizing unit is bendable.

10. The sound emitting domino of the claim 1, further comprising a base, and the sound emitter being fixed to the casing via the base.

11. The sound emitting domino of the claim 1, further comprising a buffering module disposed on the surface of the casing for buffering the shock caused by the topple.

12. The sound emitting domino of the claim 11, wherein the buffering module has a hollow portion formed therein for accommodating the casing, the shape of the hollow portion is corresponding to the shape of the casing.

13. A sound emitting domino system, comprising:

a first sound emitting domino, capable of emitting a first sound while been triggered;

a second sound emitting domino, capable of emitting a second sound while been triggered; and at least one solid domino, disposed between the first sound emitting domino and the second sound emitting domino so as to adjust the interval between the first sound and the second sound.

* * * * *